United States Patent [19]

Jones

[11] Patent Number: 4,535,582

[45] Date of Patent: Aug. 20, 1985

[54] SKIN PACKAGING MACHINE HAVING MICROPROCESSOR-BASED CONTROL

[75] Inventor: Stephen H. Jones, LaFrance, S.C.

[73] Assignee: Nordson Corporation, Amherst, Ohio

[21] Appl. No.: 441,132

[22] Filed: Nov. 12, 1982

[51] Int. Cl.[3] ..... B65B 11/52

[52] U.S. Cl. ..... 53/52; 53/77; 53/507; 53/509

[58] Field of Search ..... 53/52, 509, 427, 507, 53/508, 77

[56] References Cited

U.S. PATENT DOCUMENTS

| | | | |
|---|---|---|---|
| 3,688,414 | 9/1972 | Koehlinger et al. | 53/508 X |
| 3,745,739 | 7/1973 | Madsen et al. | 53/509 X |
| 4,064,676 | 12/1977 | King et al. | 53/509 X |
| 4,338,769 | 7/1982 | Jones | 53/509 |
| 4,417,432 | 11/1983 | Lee | 53/509 X |

*Primary Examiner*—James F. Coan

*Attorney, Agent, or Firm*—Wood, Herron & Evans

[57] ABSTRACT

A skin packaging machine for the vacuum application of a film over goods to be packaged including a microprocessor-based control. The skin packaging machine includes a film supply, an oven, a film-bearing frame, a base having a platen with a perforated surface, a blower or turbine for drawing a vacuum at the surface, and a variable speed motor for moving the frame from a position adjacent the oven to a position adjacent the perforated surface in order to apply the film to a package on the surface. The microprocessor-based control cooperates with an alphanumeric display to provide a sequential display of machine function parameters which may be individually set, such as the time duration of a particular function. The control arrangement further includes, in a test mode, means for sequentially displaying on the alphanumeric display the condition of sensors and switches.

8 Claims, 21 Drawing Figures

FROM MAIN LOOP

SET COMMAND ROUTINE

1. IF SCMEM = 0, RETURN TO MAIN LOOP.
2. IF SCMEM = 7, CHANGE "MODE" SETPOINT, UPDATE DISPLAY, AND SAVE NEW SETPOINT IN NOVRAM. WAIT UNTIL SET P.B. IS RELEASED, THEN RETURN TO MAIN LOOP.
3. IF SCMEM = 8, CLEAR CYCLES COUNT MEMORY, UPDATE DISPLAY, AND CLEAR CYCLES COUNT IN NOVRAM. WAIT UNTIL SET P.B. IS RELEASED, THEN RETURN TO MAIN LOOP.
4. IF SCMEM ≠ 0, 7 OR 8, PERFORM SETPOINT INCREMENT:
   a. WHEN 1 SECOND HAS PASSED, INCREMENT SETPOINT MEMORY.
   b. IF SETPOINT MEMORY HAS REACHED MAXIMUM, RESET SETPOINT TO 0.
   c. CONTINUE REPEATING a. & b. UNTIL SET P.B. IS RELEASED. CONTINUE UPDATING DISPLAY ALSO.
   d. WHEN SET P.B. IS RELEASED, SAVE IN NOVRAM AND RETURN TO MAIN LOOP.

TO MAIN LOOP

FIGURE 6

SKIN PACKAGING MACHINE HAVING MICROPROCESSOR-BASED CONTROL

DESCRIPTION OF THE INVENTION

This invention relates generally to skin packaging machines, and more particularly concerns such machines having automatic control arrangements therefor.

Skin packaging machines provide for the vacuum application of a film over goods to be packaged. Typically, such machines are controlled by a controller utilizing relays which switch the skin packaging machine through a sequence of operations to apply the heated film over the goods to be packaged. Such relay control systems are relatively expensive, and due to the large number of mechanical and electromechanical components, frequent maintenance can be required.

Microprocessor-based control of a skin packaging machine would appear to be an improvement over relay control systems, particularly in terms of reliability. In one microprocessor-based skin packaging machine control system, of which the applicant is aware, the skin packaging machine is controlled by the activation of a number of separate input switches. That is, a number of external input switches are accessible to permit an operator to run the skin packaging machine and to select different modes of operation. Such input switches include switches for moving the film frame down, moving the frame up, starting a packaging cycle, cutting off the film at the end of a packaging cycle, closing the film frame, moving the frame halfway up, and moving the frame fully up. In addition, this prior microprocessor-based control provides separate displays for a number of skin packaging machine conditions. Such conditions include times during which the film and package are heated, the film is preheated, and the package is cooled.

Each of the above-described skin packaging machine control arrangements utilize a number of separate control switches and a number of separately identified displays such as lights bearing legends or the like. Users of skin packaging machines very often have different requirements, such as in regard to the number of automatic functions desired on a skin packaging machine. For example, automatic clamping of the film in the frame may be provided on certain machines and not on others. This disparity of packaging requirements from one machine to the next results, in the use of the above-mentioned control arrangements, in the necessity of a separate, customized design for each different combination of packaging machine features.

In addition, although the above-mentioned microprocessor-based control scheme eliminates the use of electromechanical parts such as relays, there is still a proliferation of separate switches and lights in order to provide the control and indicator functions. There then exists, of course, the possibility of failure of one or more of such a number of controls and indicators.

It is consequently the general aim of the invention to provide a skin packaging machine having a control system with improved reliability and reduced cost. It is a related aim of the invention to provide such a control system in a skin packaging machine in which there are a reduced number of controls and indicators for the various functions of the machine.

It is a further object of the invention, in such an improved skin packaging machine, to provide in the control arrangement means for adjusting certain of the skin packaging machine parameters during actual operation of a machine cycle.

In carrying out the invention, there is provided a skin packaging machine having a control arrangement and an alphanumeric display, with the control arrangement including means for producing control signals to effect the performance of the machine functions, means for sequentially scanning on the alphanumeric display the machine parameters which characterize the various functions effected by the control signals, and means for receiving and entering input parameters to establish the function control signals.

In accordance with another aspect of the invention, means are provided for the skin packaging machine control to display sequentially, in a test mode, on the alphanumeric display, the status of sensors and switches in the skin packaging machine.

In accordance with still another aspect of the invention, the skin packging machine control includes means for adjusting the parameters, such as the time duration, of certain functions of the skin packaging machine in response to operator input during the operation of a machine cycle.

Other objects and advantages of the invention, and the manner of their implementation, will become apparent upon reading the following detailed description and upon reference to the drawings, in which:

FIGS. 4–18 are flow charts of the operation of the control system of FIG. 3.

Figure 2:
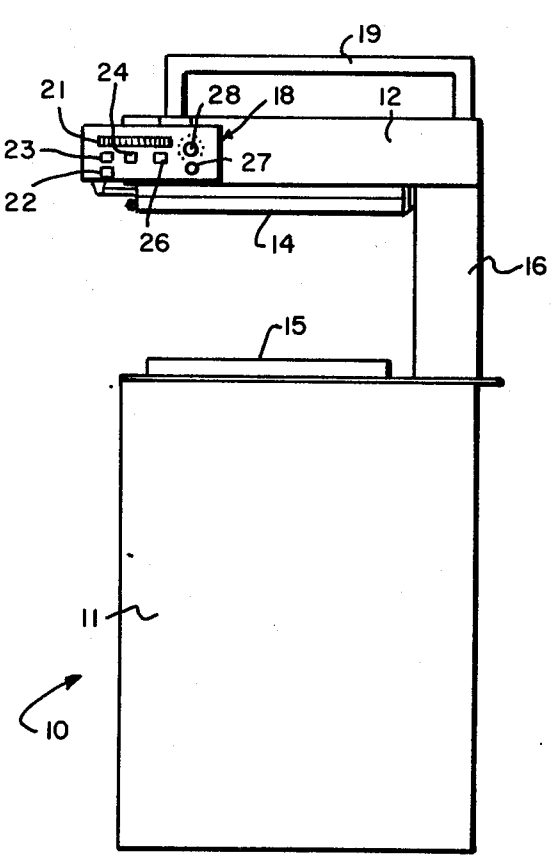
FIG. 2 is a side view of the skin packaging machine of FIG. 1.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

Figure 1:
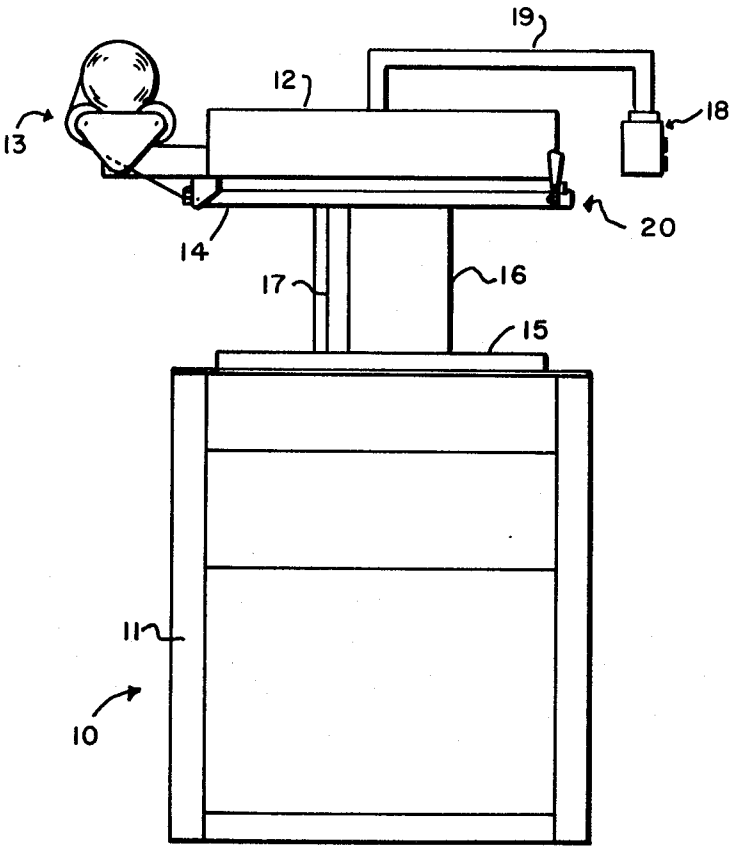
FIG. 1 is a diagrammatic front view of a skin packaging machine in accordance with the present invention.

With initial reference to FIGS. 1 and 2, a skin packaging machine 10 has a base 11 carrying a perforated platen 15 on its upper surface and containing at least one source of vacuum (not shown) for application to the perforated platen. An oven 12 is mounted over the platen for the purpose of heating a film drawn from a supply roll arrangement 13. Heated film is in turn drawn down to a substrate mounted on the perforated platen 15 in order to surround an article which is to be packaged on the substrate. A film frame 14 is mounted above the base and carries the film between two jaws which form the frame. The film, heated by the oven when the frame is in a raised position as illustrated, is thereafter placed upon the substrate on the platen 15 when the frame is moved into a lowered position. The frame 14 is reciprocated between its raised and lowered positions by a variable speed motor and chain drive (not shown), and the frame is guided and supported for such movement by a stabilizing post inside a housing 16. A guide shaft 17 cooperates with a carriage mechanism on the frame in order to permit the movement of the frame between the oven and the perforated platen.

The principal operator-accessible controls for the skin packaging machine controller are on a control box 18 which is mounted on a rotatable tubular bracket member 19 for positioning at various points around the skin packaging machine in accordance with the convenience of the operator. The operator-accessible controls are shown in FIG. 2. The control circuitry is located primarily in the base of the machine, but some portions of the circuit are in the control box 18.

As shall be described in more detail hereinafter, the control arrangement for the skin packaging machine 10 includes an alphanumeric sixteen character display 21. This display permits the operator to set various control parameters into the controller for the different functions in a cycle of operation of the skin packaging machine. The alphanumeric display 21 also permits the reading by the operator of various sensors and switch conditions of the controller. Operator-accessible controls include a RUN pushbutton switch 22 for initiating a cycle of the skin packaging machine, and a SET pushbutton switch 23 for setting various parameters, related to packaging machine functions, into the controller. The SET pushbutton switch 23 is used in cooperation with the alphanumeric display 21 in order to enter, for example, the time duration of the "preheat film" segment of an operating cycle of the machine. A SCAN pushbutton switch 24 is used to sequence through, on the alphanumeric display, the various functions which may be set by the SET pushbutton switch 23. The use of the display and pushbutton switches 21–24 shall be described in more detail hereinafter with regard to illustrative flow charts of the operation of the controller.

The control box 18 further includes a MANUAL FRAME DOWN pushbutton switch 26 to permit the operator to move the frame downwardly without initiating a packaging cycle. There is further included on the control box an EMERGENCY STOP/POWER ON switch 27 and a VACUUM ADJUST potentiometer 28. The switch 27 controls the application of power to the machine and the machine controller, and the vacuum adjust potentiometer 28 sets the amount of vacuum drawn, by a turbine (not shown) in the base of the machine, through the perforated platen 15. Inside the base of the skin packaging machine, but also operator-accessible, is a TEST switch (not shown in FIGS. 1 and 2) which permits the operator to place the control arrangement in a test mode. This mode of operation shall be discussed in more detail hereinafter.

Briefly, in order to operate the skin packaging machine 10, an operator pushes the RUN pushbutton switch 22 which causes the film cut-off to operate, then the frame 14 to rise to a position adjacent the oven 12, where engagement with a limit switch results in stopping of the frame. A card with the merchandise to be packaged is then positioned on the perforated platen 15 on the base 11.

The RUN switch is again depressed and the oven heaters are energized with full power to preheat the film in the frame. At the end of a period of time, which has been set into the controller as shall be described, the film in the frame adjacent the oven becomes droopy and the frame is lowered, placing the heated film over the card with the article of merchandise. Substantially simultaneously, a vacuum is applied through the perforated platen and the card so as to pull the film down upon the card and the article of merchandise on the card. This vacuum may be drawn by a vacuum pump, a turbine, or both, if the skin packaging machine is so-equipped and the appropriate machine cycle is selected.

Again, after a period of time during which heat is applied, and a subsequent cooling period, the vacuum is removed and the frame is opened. The packaged product is moved laterally away from the frame (to the right in FIG. 1), thereby drawing a fresh supply of film into the frame. The frame clamp is then closed. At this point, the cycle of operation is repeated by depressing the RUN pushbutton 22 to operate a cut-off knife to cut off the now-packaged product from the fresh supply of film. In the illustrated skin packaging machine, the cut-off knife comprises a heated wire assembly 20 which, in effect, heats and severs the film across its width. The film frame is then raised, and a subsequent depression of the RUN pushbutton initiates the next packaging cycle.

Figure 3:
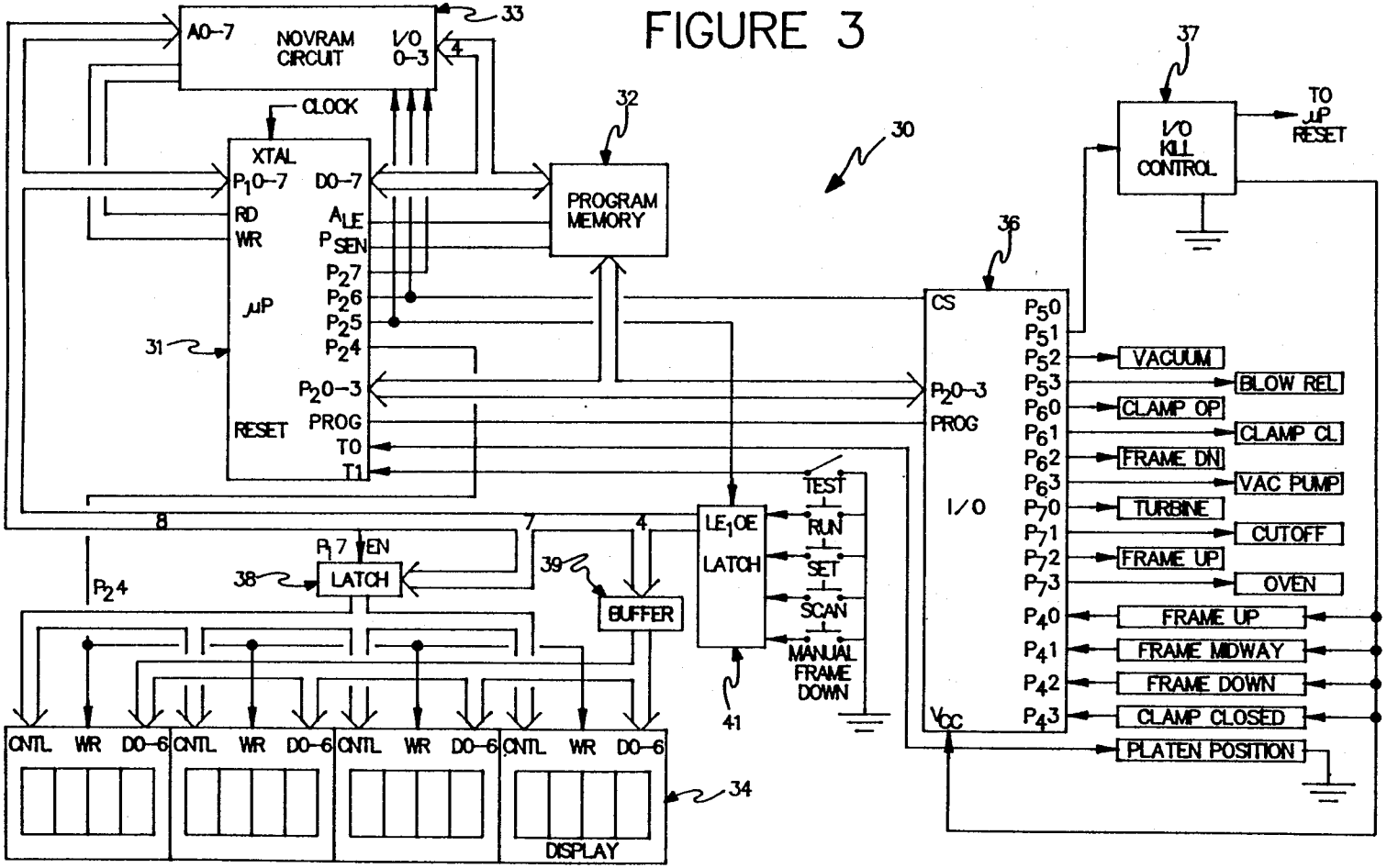
FIG. 3 is a diagrammatic circuit illustration of the control arrangement of the skin packaging machine of FIGS. 1 and 2.

Referring now to FIG. 3, the control arrangement 30 for the skin packaging machine 10 includes a microprocessor 31 and its associated program memory 32. A non-volatile random access memory circuit 33 cooperates with the microprocessor 31 to provide data storage, such as of operating parameters for particular skin packaging cycles. In the illustrated form of the invention, the microprocessor 31 is a National Semiconductor Type 80C 35. The program memory circuit 32 comprises a two kilobyte EPROM type no. 2716 and an octal latch type no. 74C373, both of which are available from National Semiconductor. As is conventional with the illustrated type of microprocessor, address information is coupled to the program memory circuit 32 using the data lines D0–7 and the address lines $P_20$–3. Data is then read from the memory on the data lines D0–7.

The use of the non-volatile random access memory (NOVRAM) circuit 33 prevents the loss of data in the case of a power interruption or in the event that the skin packaging machine is turned off for a period of time. The NOVRAM circuit 33 comprises a NOVRAM integrated circuit type no. X2210 or X2212 (64 or 256 by 4 bits) manufactured by Xicor. The NOVRAM circuit 33 further includes an AND/OR selector circuit type no. 4019 manufactured by National Semiconductor. The AND/OR selector circuit, in effect, decodes the $P_25$–$P_27$ address lines to write data to, or read data from, the backup EPROM of the memory. The AND/OR selector also, in effect, decodes the read and write lines of the processor to permit writing data to the NOVRAM or reading data from the NOVRAM. The configurations of the program memory circuit 32 and the NOVRAM circuit 33 are substantially conventional and therefore shall not be further described herein.

In general, the microprocessor 31 communicates with an alphanumeric display 34 and, by way of a I/O circuit 36 receives sensor information from, and outputs control commands to, various elements of the packaging machine. The processor 31 addresses the I/O circuit 36 using the CS and PROG inputs. Three sets of outputs are addressed through the I/O circuit 36: $P_50$–3, $P_60$–3, and $P_70$–3. The I/O circuit 36 also includes four inputs $P_40$–3 which may be coupled to the $P_20$–3 bus to the processor 31. When the processor communicates with the I/O circuit 36, the first four-bit word on the $P_20$–3 bus contains two bits of address information, selecting one of the four ports (groups of lines) $P_4$–$P_7$, and two bits of instruction information. After the first four-bit word is written to the I/O circuit 36, the processor writes a second four-bit word, in the case of the transmission of a control signal, which is effective to change the outputs of one of the ports $P_5$–$P_7$. The previously received two-bit instruction determines whether the second data transmission is to be written, ANDed, or ORed to the four outputs of the addressed port.

If the sensor port, the lines $P_40$–3, is addressed by the processor and a "read" instruction transmitted, subsequently the status of the sensors is read through the I/O circuit 36 by the processor 31. The sensors are typically limit switches and, in the illustrated form, provide an indication of the frame position, whether the frame clamp is closed, and the position of the platen, if in the particular skin packaging machine associated with the control, the platen is movable. In the illustrated circuit, the platen position sensor, if used, is coupled directly to the T0 input of the processor 31.

The illustrated controlled functions for the skin packaging machine are: application of vacuum to the platen, release of a solenoid valve providing upward air flow from the blower through the platen, opening the frame clamp, closing the frame clamp, moving the frame down, operating the vacuum pump to maintain the vacuum reservoir, operation of the vacuum turbine, operation of the film cut-off device, moving the frame up, and activating the oven. In the present circuit, a logic low from the I/O circuit 36 activates the particular device, such as the frame motor or the vacuum pump, and a logic high deactivates the device. Not all of the controlled functions are provided on all skin packaging machines utilizing the control arrangement 30. Most of the controlled functions presently comtemplated are illustrated in FIG. 3, and the control is readily modified to accommodate those actually used on a given skin packaging machine. The machine of FIGS. 1 and 2, being largely diagrammatic, does not illustrate mechanisms to implement all possible controlled functions. For example, in the illustrated machine, a manual frame clamp is shown rather than an automatically controlled clamp.

Returning to FIG. 3, the $P_51$ output of the I/O circuit 36 is coupled to an I/O kill control circuit 37, which is operable to deactivate the control system in the event of a controller malfunction. During the normal operation of the processor, watchdog timer signals are coupled on the line $P_51$ to the kill control circuit 37 in order to maintain a capacitive charge/discharge circuit in an equilibrium condition. In the event of a controller malfunction, the timer signals are no longer provided on the $P_51$ line, and the kill control circuit 37 removes the ground from the $V_{CC}$ terminal of the I/O circuit 36. The kill control circuit also "floats" the four sensor switches associated with the port $P_4$, so that the I/O circuit 36 is effectively "floating" electrically. This prevents the issuance of command signals to the various devices through ports 5–7. The kill control circuit 37 is also coupled to the microprocessor reset terminal and applies a reset to the processor, again preventing undesired operation of the controller in a fault condition. In the present circuit "brownout" protection may also be provided by effecting a reset of the processor in the event of a lowered dc supply level.

The I/O circuit, in the illustrated form of the invention, is a type 8243N integrated circuit manufactured by National Semiconductor. The controlled elements such as the frame motor, vacuum pump, and oven receive dc or ac power, as appropriate for the device, through solid state relays controlled by the control signal outputs of the I/O circuit 36.

The mioroprocessor 31 also uses the $P_10$–7 bus to write data to the display 34 and to read switch conditions from the RUN, SET, SCAN and MANUAL FRAME DOWN switches. The condition of the TEST switch is monitored through the microprocessor T1 terminal directly.

In order to write data to the display 34, the processor places an address, and then character data, on the $P_10$–7 bus. First, an address is coupled to the display 34, and, subsequently, the data indicative of an alphanumeric character to be displayed is written to the appropriately addressed portion of the display. In the first transmission, of address information, the $P_17$ line is used to enable a latch 38 to hold the address information on the other seven lines. The latch 38 latches the seven lines of address information, and couples three output lines in common to each of the four elements of the display 34. Each element of the four elements of the display is a type DL-1416 integrated circuit manufactured by Litronix. Each display element in turn contains four character locations. Two of the common lines to each of the display elements contains a two-bit address which designates a particular one of the four character locations. The other common line is a cursor line, used in checking operability of the segments of the display characters. The other four output lines from the latch 38 each run to a different one of the four elements of the display 34, with one of these lines being used to address the particular element containing the character to be displayed. Therefore, between the individual element address line, and the two-bit character location identification code sent to each of the elements, the particular character to be displayed is defined.

After the address information is latched to the display 34, the processor places the data indicative of the character to be displayed at the addressed character location on the $P_10$–7 bus. The lines $P_10$–6 are coupled through a buffer 39 to each of the elements of the display 34. The defined character is then displayed in the addressed character location of the display upon the application of a WRITE signal from the processor to the display on the $P_24$ line.

The processor 31 also reads the condition of the switches on the control panel by enabling a latch 41 on the address line $P_25$ and subsequently reading the switch condition data on the lines $P_10$–3.

As indicated above, not all control functions, or sensors, are provided on each skin packaging machine. Therefore, certain of the control lines from the I/O circuit 36 output may be unused. For example, as mentioned earlier, a skin packaging machine may often contain a manual clamp for the film frame rather than an automatic clamp, and no "clamp open" or "clamp closed" commands would be utilized. Similarly, if the platen is fixed to the base of the skin packaging machine rather than being movable, the platen position sensor input to the T0 terminal of the processor is omitted. In accordance with one aspect of the present invention, modifications to the control panel would not be necessary in order to effect the elimination or addition of such features. Since the alphanumeric display 34 provides the visual indication of control parameters and sensor conditions, any omitted controls and/or sensors are merely not utilized by the processor nor featured on the display in the operation of the control system.

While certain features illustrated in the system of FIG. 3 may be omitted, it is also possible to expand the system to a point to require the inclusion of a further I/O circuit. Such a circuit is coupled (at its CS input) to the $P_27$ address output of the processor 31 and also receives the $P_20$–3 bus and PROG line from the processor. An I/O kill control circuit may also be coupled to this additional I/O circuit. By using the additional I/O circuit, further features and control parameters may be added to the illustrated skin packaging machine, again without requiring redesign of the control panel.

Figure 16:
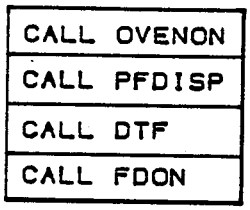
Figure 17:
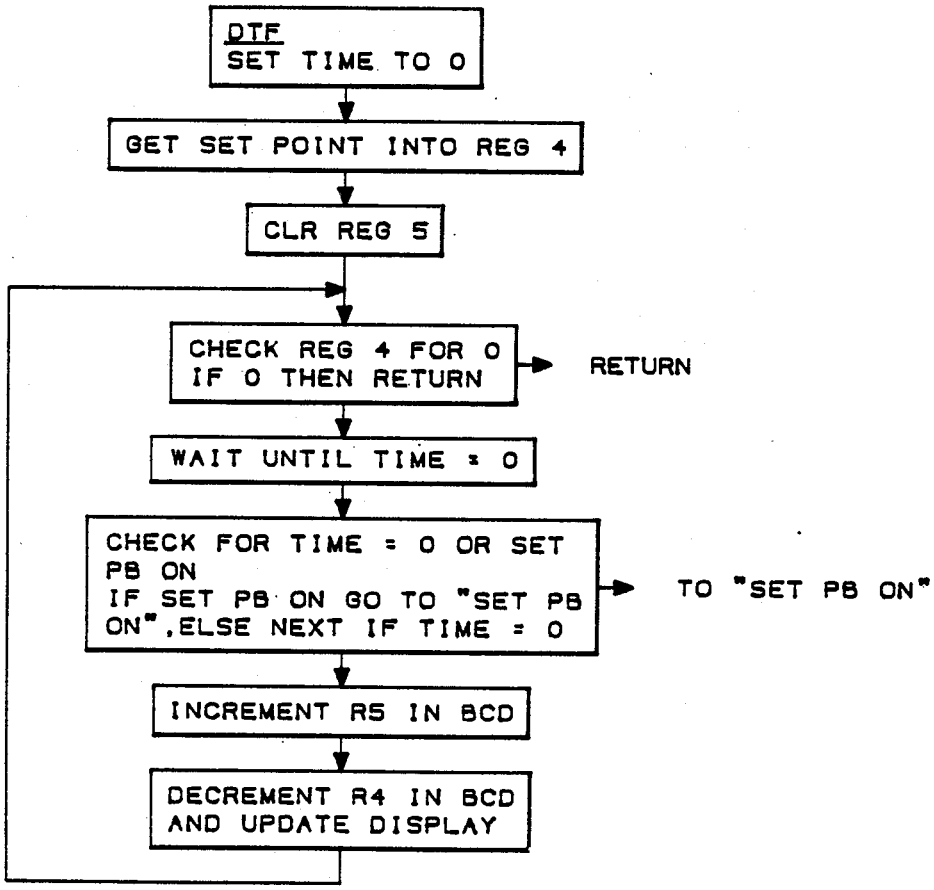
Figure 18:
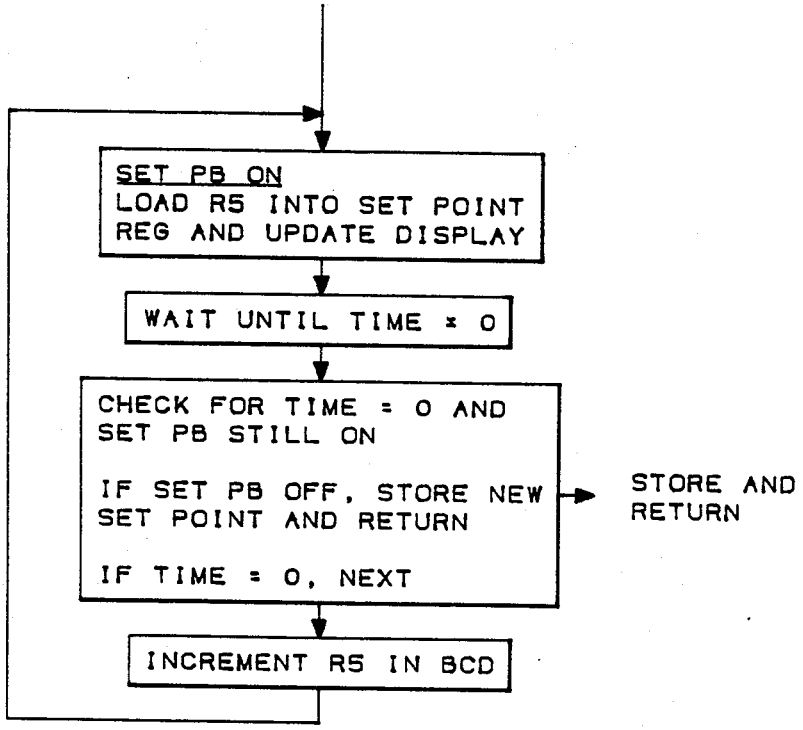

Turning now to FIGS. 4–18, certain aspects of the operation of the microprocessor-based control shall be discussed. In the operation of the control arrangement, the processor operates in a main command loop to check for input commands and display requirements. The operation of the processor in the main command loop and its associated routines is illustrated in FIGS. 4–14. The processor also operates on a ten millisecond interrupt basis to perform a real time routine, which is illustrated in FIG. 15. Finally, in the execution of a packaging machine cycle, the processor is also operative, in a subroutine, to receive modifications to setpoints, such as time durations for various cycle segments, which are input by the operator of the machine. FIGS. 16, 17 and 18 outline a typical setpoint modification of this type.

Figure 5:
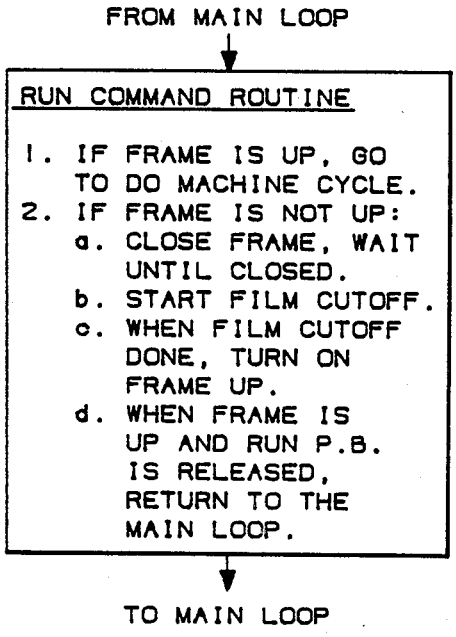

First, with regard to the main command loop, the processor continuously checks for the activation of one of the four pushbuttons, or of the test mode switch. If one of the four pushbuttons is activated, the appropriate routine is performed by the processor in accordance with the flow charts of FIGS. 5–8. The RUN pushbutton is operative, if the frame is up, to effect the beginning of a skin packaging cycle. If the frame is not up and the RUN pushbutton is depressed, the routine (2) outlined in FIG. 5 is performed to effect film cutoff and the return of the frame to the "up" position.

The machine cycle performed if the frame is in the "up" position may take several forms. Skin packaging may be performed using a turbine for drawing a vacuum, using a pump for drawing a vacuum, using both to draw a vacuum, or in the blister pack mode, where the film is formed over a mold and the cooled film ejected from the platen surface using the positive introduction of air from the blower. In an exemplary machine cycle, skin packaging in the turbine mode, the sequence of operations is as follows: frame is up, preheat film, heat package, frame is down, cool package, and cycle complete. The preheat film segment, the heat package segment, and the cool package segment of the machine cycle each have an associated setpoint time which is typically set in the control using prior operator knowledge of the package and film materials, or, as shall be described later, during the observation of an actual cycle of operation of the machine.

Before discussing the set command routine, an explanation of the parameter SCMEM is necessary. SCMEM (scan memory) defines the type of information contained within the display. The nine values (in a non-"test" mode) for SCMEM are: 0 (no scan display), 1 (preheat film), 2 (heat package), 3 (cool package), 4 (blow release), 5 (film cutoff), 6 (stand-by heat), 7 (mode display), and 8 (number of cycles).

Referring now to the set command routine, as shown in FIG. 6, any of the six machine cycle time segments can be incremented when that segment and its time are displayed on the alphanumeric display. This incrementing of a displayed time is accomplished by holding the SET pushbutton depressed. When the SET pushbutton is released, the new time period for the associated segment of a cycle is stored in the NOVRAM.

Figure 7:
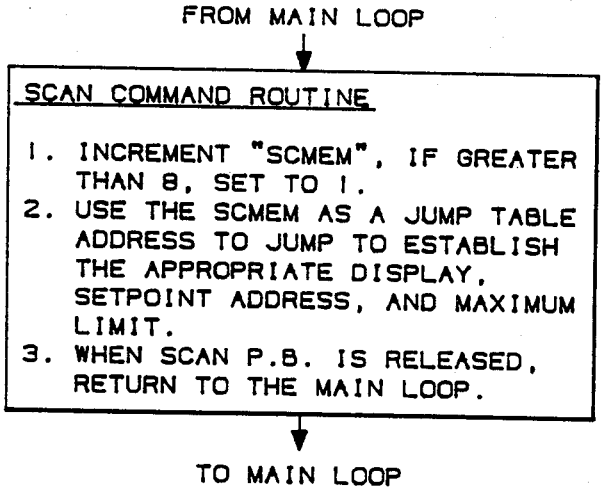
Figure 8:
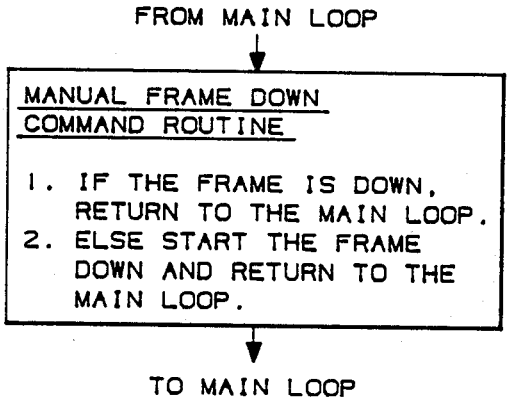
Figure 9:
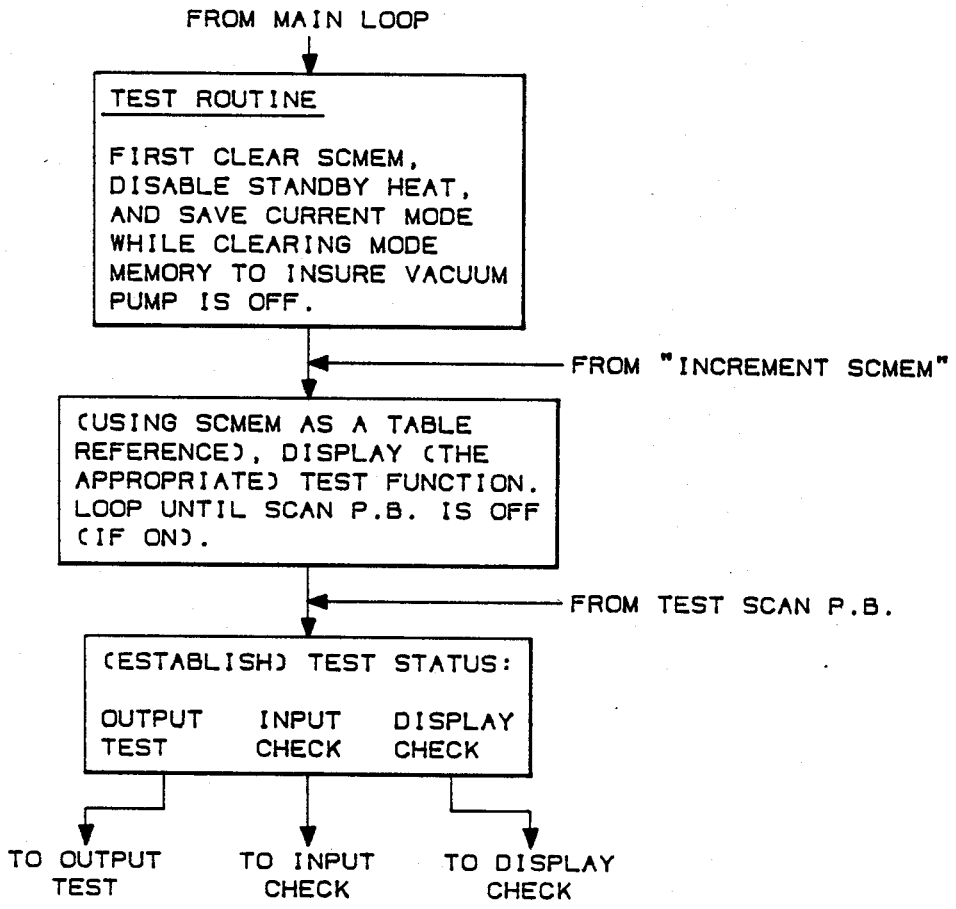

In order to place a particular segment of a machine cycle in the display, the scan command routine is utilized. As shown in FIG. 7, depressing the SCAN pushbutton not only increments the SCMEM to place the next segment in the display, but also advances a pointer to the corresponding setpoint storage location in the NOVRAM. The SCAN pushbutton must be pushed each time the next machine cycle segment is desired on the display. If the time for that segment is to be changed, the SET pushbutton is utilized, as described above.

The manual frame down routine (FIG. 8) permits the operator to move the frame down without the need for initiating an entire packaging cycle.

Figure 4:
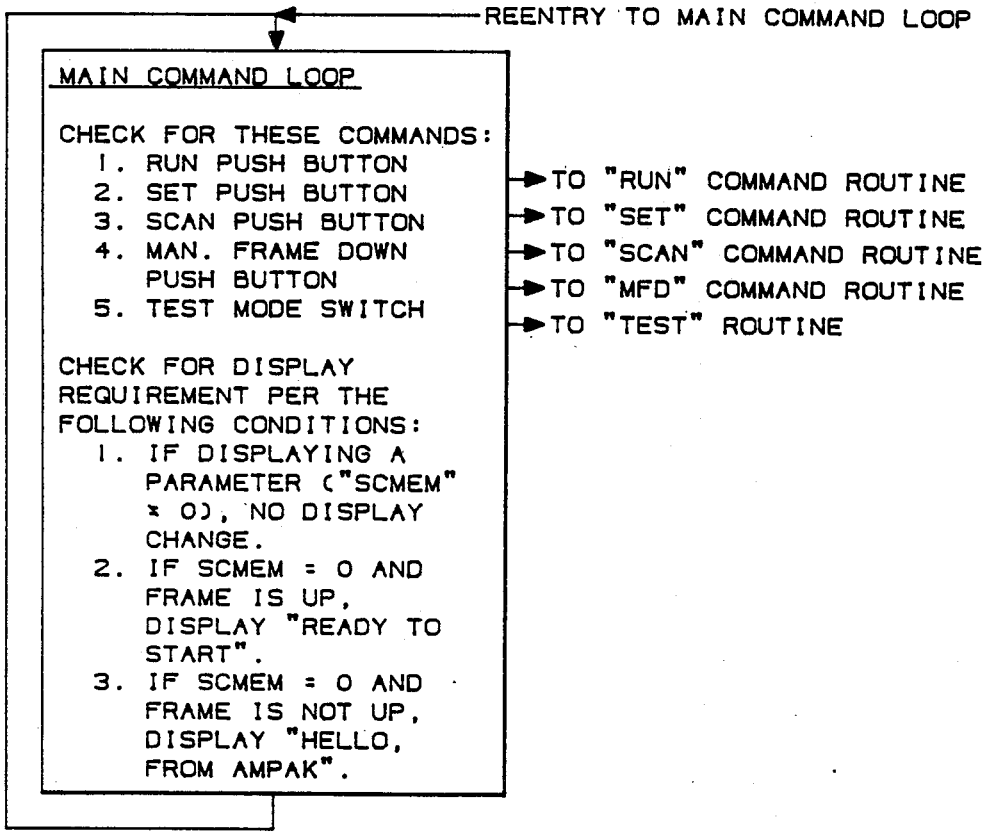

The main command loop of the processor also checks for display requirements for various conditions as set forth in FIG. 4. In actual practice, the data to be displayed is stored by the main loop routine in a display buffer, and the real time interrupt routine (to be discussed hereinafter) actually implements the display.

The test routine is initiated by activating the TEST switch inside the packaging machine cabinet. Referring now to FIGS. 9–14, when the test routine is entered, the processor loops through the output, input and display checks sequentially when the scan pushbutton is pushed. In the present control system, the tested outputs are the ten outputs from the $P_52$–$P_73$ outputs of the I/O circuit 36 (except for the vacuum pump). The input checks are for the five limit switches coupled to $P_40$–$P_43$ of the I/O chip 36 and the T0 input of the processor. Further input checks are made of the RUN pushbutton, SET pushbutton, and MANUAL FRAME DOWN pushbutton. The test routine also checks all of the segments of the display. In the test mode, these 18 conditions are checked by incrementing SCMEM, which is redefined for the test mode.

Figure 10:
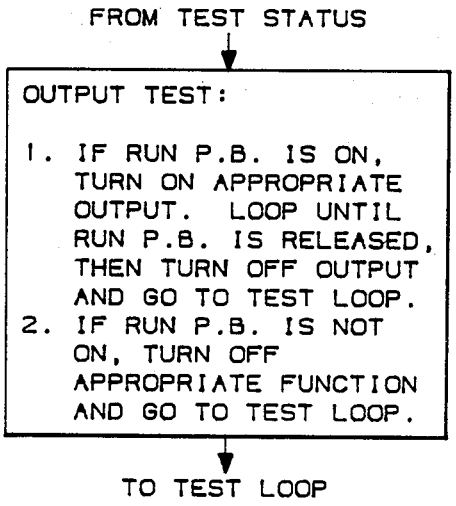
Figure 11:
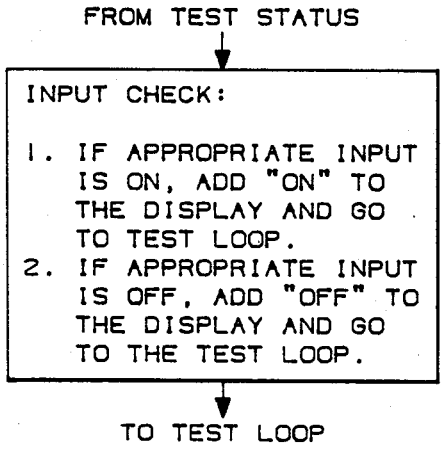
Figure 12:
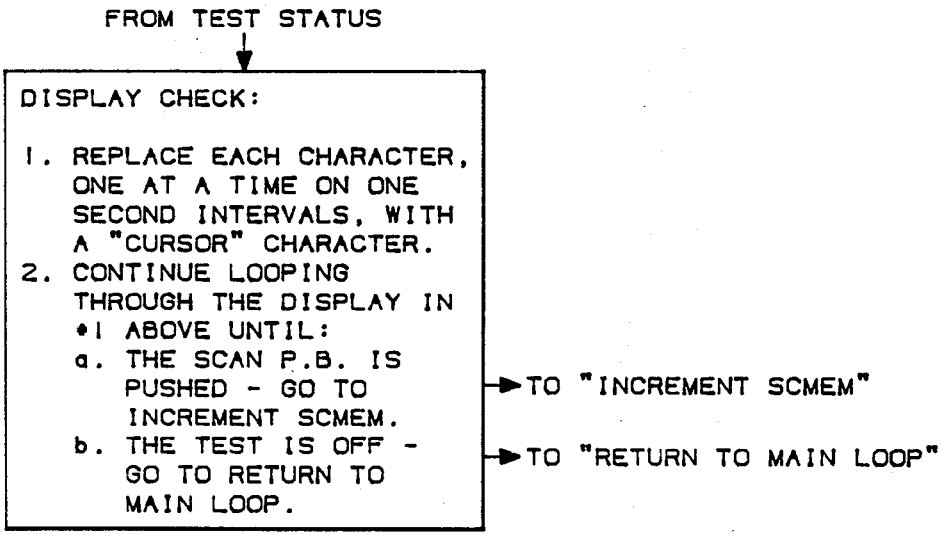
Figure 13:
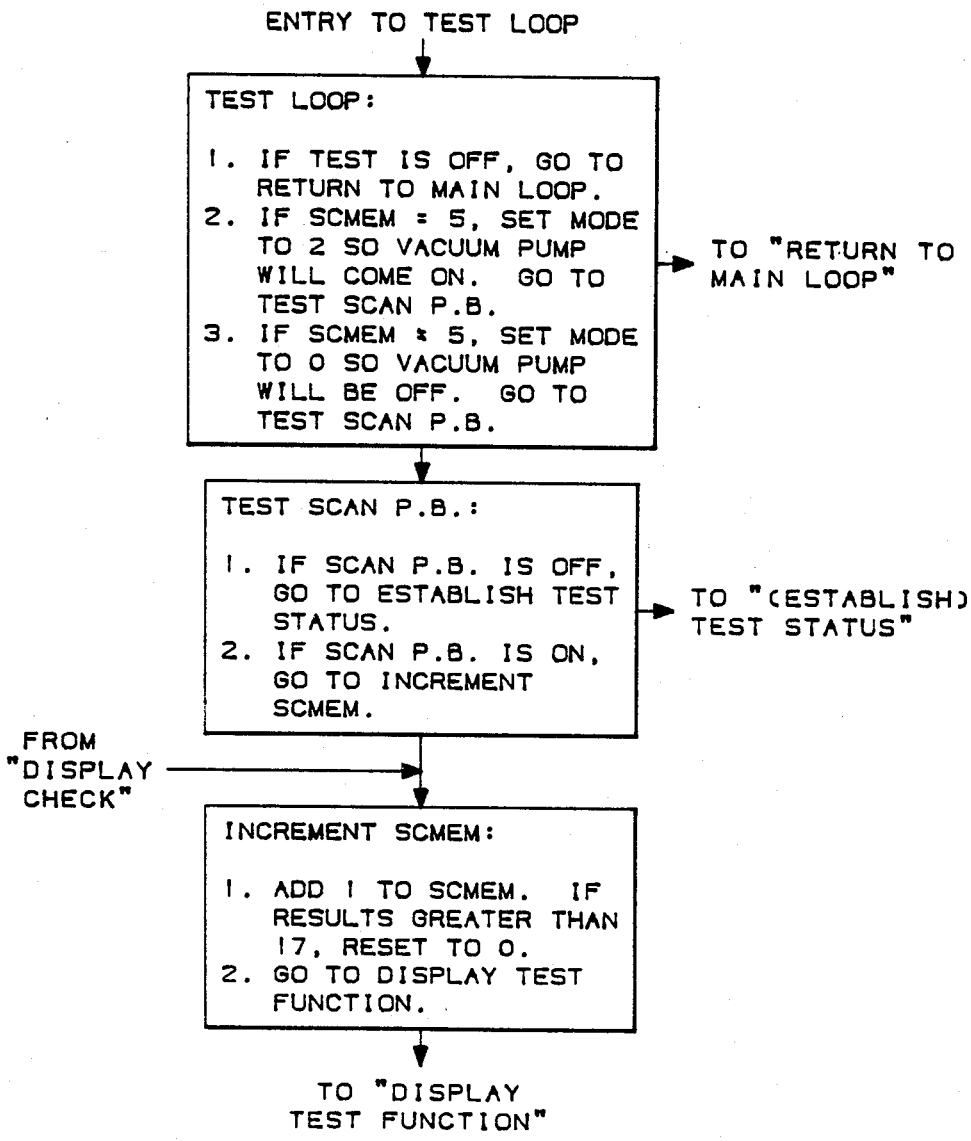

The routines for each of these checks are outlined in FIGS. 10–12. After each of these routines, the test loop routine of FIG. 13 is entered. As shown in FIG. 13, after entering the test loop routine, if the test switch has been turned off, the processor goes to the "return to main loop" subroutine. If the SCAN pushbutton is off, the processor returns to the "(establish) test status" step of the routine (FIG. 9) and continues to test the same selected parameter. If the SCAN pushbutton is on, the SCMEM is incremented, and the next parameter and its status is displayed.

Figure 14:
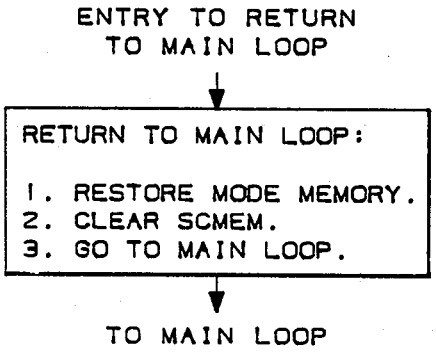
Figure 15A:
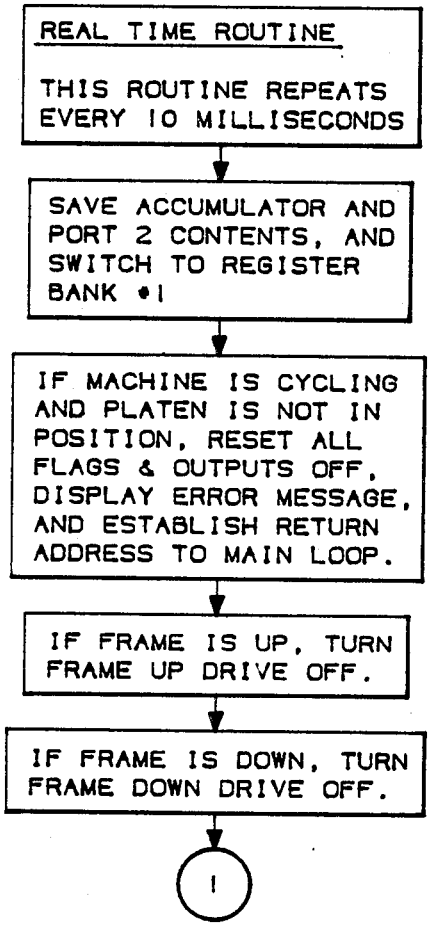
Figure 15B:
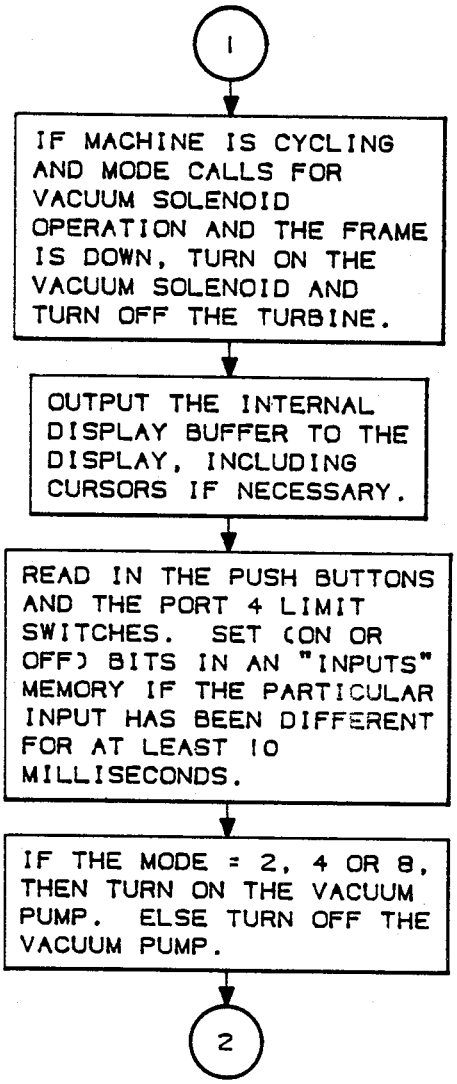
Figure 15C:
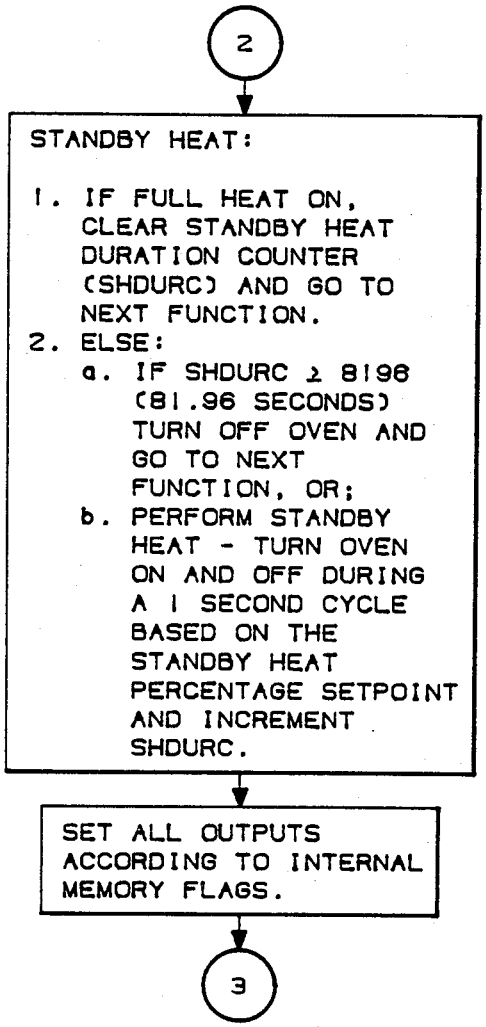
Figure 15D:
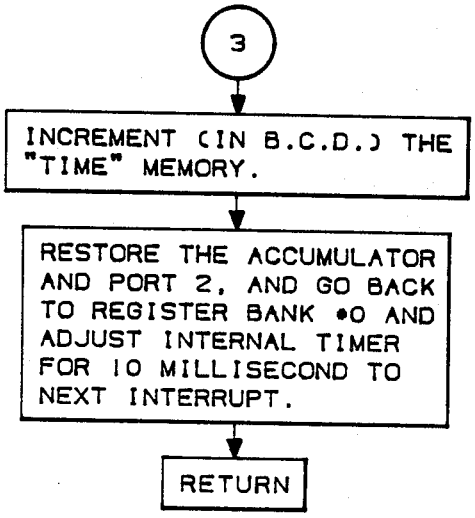

In order to exit the test routine, the "return to main loop" subroutine of FIG. 14 is executed. This restores the mode memory and clears SCMEM before returning to the main loop.

Certain of the processor functions are performed in a real time routine on an interrupt basis, with the real time routine being initiated every ten milliseconds. With reference to FIG. 15, the processor first checks various status indications and responds thereto such as by turning off the frame drive if the frame is fully up or down. Similarly, the processor assures that the vacuum solenoid is activated and the turbine turned off if vacuum is called for during the current machine cycle. The processor also outputs the internal display buffer to the display. The processor additionally reads in the pushbuttons and the port $P_4$ limit switches and performs "de-bouncing" for the inputs from the pushbuttons and limit switches. In the appropriate modes of operation calling for vacuum, the vacuum pump is turned on. In addition, the appropriate stand-by heat is applied by appropriate activation of the oven heaters. The processor also causes the outputs to be turned on or off as required by the program. The processor then conditions the internal ten millisecond timer for the next interrupt and returns to the routine that was interrupted to perform the real time routine.

As discussed earlier, any timed segment of a machine cycle can be set by scanning to the particular segment and incrementing the time for that segment by holding down the SET pushbutton. In addition, the time duration of machine cycle segments can be set while the skin packaging machine operator observes a sample cycle. This is advantageous in that many of the time periods in a skin packaging machine cycle are best set empirically. This avoids calculation and guess work as to initial settings of time periods in the packaging machine cycle.

With reference to FIG. 16, a portion of a typical skin packaging machine cycle is illustrated. First, an OVENON subroutine is called to turn on the oven to preheat the film. Next, a PFDISP subroutine is called to establish the display and locate the corresponding setpoint memory address. The particular segment of the cycle is displayed (in this case, "preheat film") and the remaining time for that segment is decremented in the display by a DTF subroutine, to be described hereinafter. After the "preheat film" time has been decremented to zero, the FDON subroutine is called to move the film frame down onto the package. The DTF (dynamic timing function) subroutine is used in decrementing each timed segment of a machine cycle.

The DTF subroutine operates as illustrated in FIGS. 17 and 18. Beginning in FIG. 17, a one hundredth of a second timer, which counts up to one second and resets, is initially set to zero. Then the setpoint from the NOVRAM is placed in a register (4). This setpoint is the previously stored time for the "preheat film" segment of the machine cycle. Register 5 is then cleared. Thereafter, each second, the processor decrements the stored time in the register 4 and increments the elapsed time in the register 5. When the register 4 has been decremented to zero, the processor returns to the machine cycle routine which then calls the next subroutine, in this case, FDON to move the frame down.

If, at any time during the execution of the portion of the DTF subroutine illustrated in FIG. 17, the SET pushbutton is activated, the processor goes to the "SET pushbutton on" portion of the subroutine illustrated in FIG. 18. When the processor recognizes that the SET pushbutton has been activated, the elapsed time value in the register 5 is loaded into the setpoint register, and the display is updated to reflect this amount of time. As long as the SET pushbutton is held on, the processor continues to increment the time for the displayed segment of the machine cycle. When the SET pushbutton is released, the new setpoint is stored in the NOVRAM, and the processor proceeds to the next subroutine in the machine cycle.

This same incrementing of times for the various segments of a machine cycle can be repeated for each segment in an entire machine cycle in order to establish the setpoints for skin packaging particular packages with a particular type of film by observing the actual machine operation and condition of the film. For example, in setting the preheat time period, the operator maintains the SET pushbutton depressed during film preheat until the film heats and becomes droopy. Thereupon, the SET pushbutton is released and the observed time period for the preheat segment of the cycle is stored and the skin packaging machine proceeds to the next segment of the cycle. For the next package, the correct preheat time is stored in the controller.

What is claimed is:

1. A skin packaging machine comprising an oven, a frame adapted to receive film from a film supply, a base having a perforated surface, means for drawing a vacuum at the surface, and means for moving the frame from a position adjacent the oven to a position adjacent the perforated surface, an alphanumeric display, and a control arrangement including means for producing control signals to effect operation of functions of the skin packaging machine in accordance with parameters such as time input to the control arrangement, means for successively displaying skin packaging machine functions on the alphanumeric display, and means for entering parameter information related to functions displayed on the alphanumeric display.

2. The skin packaging machine of claim 1 in which the control arrangement includes, in a run mode, means for producing said control signals in accordance with the entered parametr information to effect movement of the film frame.

3. The skin packaging machine of claim 2 in which the control arrangement is placed in the run mode by the activation of a run switch which is operable to move the frame from a position adjacent the oven to a position adjacent the perforated surface, or from any other position to a position adjacent the oven.

4. A skin packaging machine comprising an oven, a frame adapted to receive film from a film supply, a base having a perforated surface, means for drawing a vacuum at the surface, means for moving the frame from a position adjacent the oven to a position adjacent the perforated surface, an alphanumeric display, and a microprocessor-based control arrangement including a number of condition sensors including film frame position sensors, means for reading the condition of said seonsors, and means for displaying, in a test mode, the conditions read from said sensors sequentially in the alphanumeric display.

5. The skin packaging machine of claim 4 in which the control arrangement further includes a plurality of input switches, and, in the test mode, the status of these switches is read by said reading means and sequentially displayed on the alphanumeric display by said display means.

6. The skin packaging machine of claim 5 which further includes a test switch, the activation of which is operable to place the control arrangement in the test mode.

7. A skin packaging machine comprising an oven, a frame adapted to receive film from a film supply, a base having a perforated surface, means for drawing a vacuum at the surface, and means for moving the frame from a position adjacent the oven to a position adjacent the perforated surface, an alphanumeric display, and a control arrangement including means for producing control signals to effect operation of functions of the skin packaging machine in accordance with parameters such as time input to the control arrangement, means for successively displaying skin packaging machine functions on the alphanumeric display, and means for entering parameter information related to functions displayed on the alphanumeric display, the control arrangement further including a number of condition sensors including film frame position sensors, means for reading the condition of said sensors, and means for displaying, in a test mode, the conditions read from said sensors sequentially in the alphanumeric display.

8. A skin packaging machine comprising an oven, a frame adapted to receive film from a film supply, a base having a perforated surface, means for drawing a vacuum at the surface, and means for moving the frame from a position adjacent the oven to a position adjacent the perforated surface, an alphanumeric display, and a control arrangement including means for producing control signals to effect operation of functions of the skin packaging machine in accordance with parameters such as time input to the control arrangement, means for successively displaying skin packaging machine functions on the alphanumeric display during a machine cycle, and means for entering parameter information related to functions displayed on the alphanumeric display, which replaces parameter information previously stored by the control arrangement.

* * * * *